US006868240B2

(12) United States Patent
Ozawa et al.

(10) Patent No.: US 6,868,240 B2
(45) Date of Patent: Mar. 15, 2005

(54) METHOD FOR DEVELOPING IN HYBRID DEVELOPING APPARATUS

(75) Inventors: Yoshio Ozawa, Watarai-gun (JP); Shoichi Sakata, Watarai-gun (JP); Toshinori Nishimura, Watarai-gun (JP)

(73) Assignee: Kyocera Corporation (JP)

( * ) Notice: Subject to any disclaimer, the term of this patent is extended or adjusted under 35 U.S.C. 154(b) by 11 days.

(21) Appl. No.: 10/388,563

(22) Filed: Mar. 14, 2003

(65) Prior Publication Data

US 2004/0002015 A1 Jan. 1, 2004

(30) Foreign Application Priority Data

Mar. 15, 2002 (JP) ..... 2002-072666
Mar. 26, 2002 (JP) ..... 2002-086249

(51) Int. Cl.[7] ..... G03G 15/09; G03G 21/00

(52) U.S. Cl. ..... 399/43; 399/53; 399/127; 399/282

(58) Field of Search ..... 399/45, 43, 53, 399/58, 267, 272, 282, 149, 127

(56) References Cited

U.S. PATENT DOCUMENTS

| | | | |
|---|---|---|---|
| 3,866,574 A | 2/1975 | Hardennrook et al. | |
| 3,929,098 A | 12/1975 | Leibman | |
| 5,341,197 A | 8/1994 | Folkins et al. | |
| 5,420,375 A | 5/1995 | Folkins et al. | |

FOREIGN PATENT DOCUMENTS

| | | | |
|---|---|---|---|
| EP | 1220525 A2 * | 7/2002 | ..... H04N/1/00 |
| JP | 59121077 | 7/1984 | |
| JP | 63249164 | 10/1988 | |
| JP | 3113474 | 5/1991 | |

(List continued on next page.)

OTHER PUBLICATIONS

English Abstract JP 3113474.
English Abstract JP 59121077.
English Abstract JP 11231652.
English Abstract JP 2000081788.
English Abstract JP 7128983.
English Abstract JP 63249164.

(List continued on next page.)

*Primary Examiner*—Susan Lee
(74) *Attorney, Agent, or Firm*—Schulte Roth & Zabel LLP; Joel E. Lutzker; John C. Garces

(57) ABSTRACT

To avoid developing ghost and selective developing without complicating a developing apparatus and to supply surly charged toner to a developing roll while unevenness of images is not generated to obtain stable images for a long time even when continuous printing, a method for developing in a hybrid developing apparatus is provided, which is characterized in that a data amount of each image, which an image forming apparatus prints and a number of paper sheets passed are detected and that an interval of the action of recovering and exchanging a toner layer on the developing roll to the magnetic roll after printing between paper sheets is variably set in accordance with a printing coefficient determined by the data amount and the number of paper sheets passed and further, a method for developing in a color tandem-type image forming apparatus provided with a plurality of the hybrid developing apparatuses for all different colors of toner, which are disposed along the moving direction of a transfer medium of images is provided, wherein after toner layers on the developing rolls of the all developing apparatuses are peeled off toward the magnetic rolls after developing, a thickness of the toner layer of the each developing apparatus is variably controlled at the beginning of developing in accordance with the image consistency of the developing apparatus having a highest image consistency among image data of toner colors.

12 Claims, 4 Drawing Sheets

FOREIGN PATENT DOCUMENTS

| | | |
|---|---|---|
| JP | 6067546 | 3/1994 |
| JP | 7072733 | 3/1995 |
| JP | 7092804 | 4/1995 |
| JP | 7128983 | 5/1995 |
| JP | 10031366 | 2/1998 |
| JP | 11231652 | 8/1999 |
| JP | 2000081788 | 3/2000 |
| JP | 20000250294 | 9/2000 |

OTHER PUBLICATIONS

English Abstract JP 10031366.
English Abstract JP 6067546.
English Abstract JP 7072733.
English Abstract JP 7092804.
English Abstract JP 2000250294.

* cited by examiner

| Volume Resistivity($\Omega \cdot cm^3$) of Sleeve | 1.00E+03 | 1.00E+04 | 1.00E+05 | 1.00E+06 | 1.00E+07 | 1.00E+08 |
|---|---|---|---|---|---|---|
| Image Consistancy (Initial 1.43) (After Printing 1000 Sheets) | 1.40 | 1.40 | 1.38 | 1.37 | 1.25 | 1.20 |

Vdc1:100V Vdc2:350V 27bØAC:Vpp 1.5Kv f 3.0KHz Duty 30%

Wave Form: Square Wave

| Thickness of Toner Layer ($mg/cm^2$) | 0.4 | 0.6 | 1.0 | 1.3 | 1.7 | 2.0 |
|---|---|---|---|---|---|---|
| Ghost | ○ | ○ | ○ | ○ | × | × |
| Scattering | ○ | ○ | ○ | ○ | △ | × |
| Performance for Following Solid Images | × | ○ | ○ | ○ | ○ | ○ |

FIG.7

After printing continuously 10,000 sheets of printing data of 5 % of image data.

| | Initial | Successive 10000 Sheets Printing | Toner Layer Exchanged after Every 20 Sheets Printing |
|---|---|---|---|
| Consistency | 1.60 | 1.25 | 1.56 |
| Ghost | O | × | O |
| Stainning of Developing Roll | O | × | O |
| Charge Amount of Toner μ C/g | 12.50 | 22.50 | 15.30 |
| Volume Average Particle Size μm | 7.55 | 6.15 | 7.25 |

A sample of toner for toner particle size measurement is taken from the toner on the developing roll at the begining of developing

FIG.8

After printing continuously 100 sheets of solid printing data of 100 % of image data.

| | Initial | Successive 10000 Sheets Printing | Toner Layer Exchanged after Every 10 Sheets Printing | Toner Layer Exchanged after Every 10 Sheets Printing Vdc2-Vdc1 is up by 50v |
|---|---|---|---|---|
| Consistency | 1.60 | 1.10 | 1.45 | 1.55 |
| Performance | O | × | O | O |
| Charge Amount of Toner μ C/g | 12.50 | 7.40 | 11.50 | 12.00 |
| Volume Average Particle Size μm | 7.55 | 6.35 | 7.30 | 7.40 |

A sample of toner for toner particle size measurement is taken from the toner on the developing roll at the begining of developing

METHOD FOR DEVELOPING IN HYBRID DEVELOPING APPARATUS

BACKGROUND OF THE INVENTION

1. Field of the Invention

The present invention relates to an image forming apparatus, particularly a color tandem image forming apparatus utilizing electrophotography such as a copying machine, a printer, a facsimile and a complex machine of those, more specifically, relates to an image forming apparatus having a hybrid developing apparatus which develops a latent image to which an isolated charged toner is caused to jump from a developing roll holding the isolated charged toner on it using two components developer material, in which non-magnetic toner is charged by means of magnetic carrier.

2. Description of the Related Art

Heretofore, there are kinds of developing methods in an image forming apparatus utilizing electrophotography such as a copying machine, a printer, a facsimile and a complex machine of those. One is a two-components developer material method which uses toner and magnetic carrier; another is one-component developer material method which uses nonconductive toner or conductive toner. Another one is a hybrid developing method which develops a latent image twohich an isolated charged toner is caused to jump from a developing roll holding the isolated charged toner on it using two components developer material, in which non-magnetic toner is charged by means of magnetic carrier.

A two parts developer material method has advantages of such as excellent charging property of toner by carrier, long life of toner as well as uniformity of solid image. On the other hand, it has drawbacks of such as a large and complicated developing apparatus, generation of toner scattering or carrier accompanying as well as varying image quality depending on durability of carrier. A one-component developer material method has advantages of a compact developing apparatus as well as good dot reproducibility while it has drawbacks of the poor durability of a developing roll and a charge roller, which results in selective developing or high maintenance cost of supplies and material for developing apparatus. A hybrid developing method is a high rate image forming method which has good dot reproducibility and a long life, however it has heretofore such problems as generation of developing ghost or toner scattering.

Though a hybrid developing method has been developed as one of measures for a one-component non-contact developing, it has been recently developed as a high rate developing method for a developing method of superimposing multi-colors on one drum, in which a plurality of color images are sequentially formed on one latent image bearing body (a photosensitive body). Attention has been paid to this method as an art of quality color images because a color image with scarce color drift can be obtained by accurately overlapping different colored layers of toner on a latent image bearing body.

However, since developing apparatuses of a number of colors used should be disposed around the latent image bearing body in a developing method of superimposing multi-colors on one drum, the latent image bearing body becomes large in size so as to prevent from designing a compact image forming apparatus. Hence, attention has been paid to a tandem method in which a plurality of electro-photographic process units corresponding to colored toners used are aligned and colored images are formed synchronized with transferring of a transfer member so as to overlapping the colored images on the transfer member. However, this method has a drawback that the image forming apparatus becomes large because electro-photographic process units of kinds of colors should be aligned, though it has an advantage in having a rapid rate of printing. In order to improve measures against this problem, a compact tandem image forming apparatus has been proposed, which is provided with a small-sized image forming unit by narrowing a distance between latent image bearing bodies.

The compact tandem image forming apparatus thus designed has an advantage when it has a vertical developing apparatus in order to minimize a size in width direction of the image forming unit. That is, it is desirable regarding parts layout to dispose a developing apparatus in the upper part of the latent image bearing body. However, in case the developing apparatus is disposed in a vertical manner in a conventional two-components developer material method, flow of developer material, that is, the supply of developer material from a developer mixer to the part adjacent to a latent image bearing body is complicated so that downsizing of the apparatus is limited, carrier adheres inevitably to the latent image bearing body and toner scatters unavoidably.

Though, as another method, a one-component developer material method in which carrier is not used is proposed, it has a drawback of enhancing color drift, which is the weak point of a tandem type, on account of the torque fluctuation of a latent image bearing body caused by contacting a developing roll to the latent image bearing body. Meanwhile, with a method in which a latent image bearing body is not touched, toner is charged by a charge roll and the toner thickness on the developing roll is restricted by an elastic restricting blade. Thus, additive for toner adheres to the charge roll so that the charging ability is decreased or toner adheres to the restricting blade so that toner thickness becomes uneven, which results in image defects.

Hence, as a measure for resolving the problems, the aforementioned hybrid developing method has attracted attention. Though the hybrid developing method has the problems with regard to generation of ghost and scattering of toner, the method has little torque fluctuation owing to non-contacting between the developing roll and the image bearing body as well as excellent dot reproducibility so as to be able to provide a high-speed image forming apparatus capable of a long life.

A prior art regarding a hybrid developing method is disclosed in U.S. Pat. No. 3,866,574 which proposes a method wherein a non-magnetic toner thin layer is formed on a donor roll (developing roll) disposed untouchably toward a latent image bearing body and the toner is caused to jump to the latent image on the latent image bearing body by an alternative current electric field. While, U.S. Pat. No. 3,929,098 shows a developing apparatus which forms a toner layer by transferring the toner onto a donor roll using a magnetic roll.

However, although these arts enable toner to form a thin layer on a donor roll by means of two-components developer material, a strong alternative current electric field is necessary to separate toner from the donor when the electrostatic charge of the toner is high. The strong alternative current electric field disturbs the toner layer so that a problem concerning superimposing multi-colors arises. In this regard, so called a powder cloud developing method is disclosed in Japanese laid open patent publication, No. JP1992-113474 wherein auxiliary electrodes consisting of wires are provided between a donor roll and a latent image bearing body applying a weak alternative current electric field so as not to disturb the toner developed.

Theoretical aspect of the formation of toner layer on a developing roll using two-component developer material was reported by Toshiba Corporation in the Electrophotography Society Journal 19, 2 (1981) and the art is disclosed in Japanese laid-open patent publication JP1984-121077.

The aforementioned prior arts have a tendency of decreasing image consistency owing to selective developing as coarse particles of the high developing natured toner are apt to selectively jump to the latent image body and fine particles of the highly charged toner remains on the developing roll sleeve. Further, the control of charging toner is complicated so that a high surface potential and a big developing electrical field need to be applied. In this regard, if both toner consumption region and non-consumption region are generated on the developing roll, toner adhering state and toner potential vary on the surface of the developing roll. Thus, as shown in FIG. 3, so called a hysteresis, a phenomenon in which a part of previous developing image appears as a ghost is liable to generate. In FIG. 3, 35 is a solid image consisting of a rectangular black image and 36, 37 are half tone image succeeding and broader than the solid image. When both toner consumption region and non-consumption region are generated on the developing roll, printing the half tone images 36, 37 after the solid image 35 generates the ghost shown in FIG. 3(*b*). Further in case high consistent images are printed repeatedly, unevenness of image such as mottle in image consistency is liable to occur so that a problem in down sizing the apparatus arises.

In order to overcome this problem, Japanese laid-open patent publication JP1999-231652 discloses a member for scraping the residual toner on a developing roll and a recovery device for the scraped toner, while Japanese laid-open patent publication JP2000-81788 discloses an apparatus using an exclusive recovery roll for assuring recovery of toner on the developing roll. However these methods are necessary for complex structures enabling to make practical for a compact electrophotographic apparatus. Further, Japanese laid-open patent publication JP1995-128983 discloses an apparatus wherein toner on a developing roll is recovered by setting a broad half value region of magnetic density of a magnetic roll as a measure for the hysteresis when using magnetic brushes. Japanese laid-open patent publication JP1988-249164 discloses a control method for a developing apparatus of tandem type wherein degradation of developer material is prevented by bringing down the operation of developing apparatus in an image forming part except for the image forming part whereat a transfer process is performed. In order to prevent big effect for image quality caused by fluctuation of a toner concentration in two-component developer material, Japanese laid-open patent publication JP1998-31366 discloses a developing apparatus of non-contact method for two-component developer material wherein toner consumption is predicted by image data by providing a plurality sets of developing magnetic pole and a trimming magnetic pole for fixing toner replenishing amount on a magnetic roll while a position of the trimming magnetic pole is adjusted so as to be capable of supplying a most appropriate toner amount from the actual toner amount on a latent image bearing body and the predicted toner consuming amount by providing a device for detecting a toner amount on the latent image bearing body.

In a hybrid developing method, decreasing of image consistency owing to selective developing or developing defect, image degradation, developing ghost, toner scattering and sleeve adhesion owing to leaving for a long lime while holding toner on a developing roll are generated. In order to solve the aforementioned problems, Japanese laid-open patent publication JP1994-67546, JP1995-72733 and JP1995-92804 disclose an image forming apparatus having a magnetic roll forming magnetic brushes by two-components developer material, a donor roll (developing roll) holding a toner thin layer supplied by the magnetic roll and electrodes disposed between the donor roll and a latent image bearing body wherein bias consisting of alternate current and direct current voltage are applied to the electrodes, direct current bias is applied to the developing roll and polarity reversible direct current bias by a switch (JP1995-72733) or alternate current bias superposed on direct current (JP1994-67546 and JP1995-92804) is applied to the magnetic roll.

In a developing apparatus described in JP1994-67546 or JP1995-72733, a toner thin layer is formed on the developing roll with magnetic brushes generated on the magnetic roll with direct current potential difference (JP1995-72733) or alternate current bias (JP1994-67546 and JP1995-92804) between the magnetic roll and the developing roll and further a latent image on the latent image bearing body is developed by forming toner cloud near the electrodes with an alternate current bias superposed on direct current applied between the developing roll and the electrodes while the toner on the developing roll is recovered by applying a direct current bias in the direction of peeling toner from the developing roll to the magnetic roll with switching after formation of images (JP1995-72733) and JP1995-92804 or at a definite interval (JP1994-67546) and by applying a direct current bias (JP1995-72733) in the direction of transferring toner on the magnetic roll to the developing roll with switching at the successive image formation, whereby formation of images are prepared to solve the above mentioned problems.

Japanese laid-open patent publication JP1995-72733, U.S. Pat. No. 5,420,375, disclose a hybrid developing apparatus having a magnetic roll forming magnetic brushes by two-components developer material, a donor roll (developing roll) holding a toner thin layer supplied by the magnetic roll and electrodes disposed between the donor roll and a latent image bearing body wherein a bias consisting of direct current and alternate current is applied to the electrodes and to the magnetic roll is applied direct current bias capable of changing polarity with a switch whereby such problems as decreasing of image consistency owing to selective developing or developing defect, image degradation, developing ghost, toner scattering and sleeve adhesion owing to leaving for a long time while holding toner on a developing roll are solved.

That is to say, in the developing apparatus disclosed in JP1995-72733, a toner thin layer is formed on a magnetic roll with a potential difference between the magnetic roll and a developing roll and a latent image on the latent image bearing body is developed by forming toner cloud near the electrodes with an alternate current bias superposed on direct current applied between the developing roll and the electrodes while the toner on the developing roll is recovered by applying a direct current bias in the direction of peeling toner from the developing roll to the magnetic roll with switching after formation of images and by applying a direct current bias in the direction of transferring toner on the magnetic roll to the developing roll with switching at the successive image formation, whereby formation of images are prepared to solve the above mentioned problems.

In JP2000-250294, it is argued that a method in which electrodes are provided between a developing roll and a latent image bearing body disclosed in JP1995-72733 has such draw back as an uneven phenomenon owing to vibration of wires tensed with electrical bias and generation of scars on the developing roll by dust attached instantaneously on the electrodes. A hybrid developing apparatus having electrodes buried in a developing roll is introduced as a prior art. Even in the apparatus using a developing roll with electrodes buried in the roll, carrier attached on the developing roll sticks to images and toner is not effectively supplied to the latent image bearing body because electrodes buried in the roll have a certain distance between them. Consequently, the apparatus generates a phenomenon of empty images when images of high image ratio are continuously printed or a phenomenon of low quality image or low image consistency caused by selective development on account of alternate current bias applied to the magnetic roll and the developing roll so that the patent publication disclosed a hybrid developing apparatus preventing these phenomenon.

Namely, in the patent publication JP2000-250294, a dielectric layer into which electrodes are buried with a small distance is provided on a electroconductive sleeve to constitute a developing roll whereby improving the effectiveness of supplying toner to a latent image bearing body, preventing short-circuiting between electrodes and protecting the surface. In addition, an electrode-relaxation-allowing layer having a dielectric constant with which cumulated electric charges can be diffused and capable of fringe charge penetrating through the coating for a shorter time than several seconds is provided. A brush electrode supplying a bias voltage consisting of alternate current voltage and dielectric current voltage to the electrodes buried in the developing roll is provided between the developing roll and the latent image bearing body and another brush electrode supplying another bias voltage consisting of alternate current voltage and dielectric current voltage to the electrodes buried in the developing roll is provided between the developing roll and magnetic roll, so that, a latent image on the latent image bearing body is developed with a cloud of toner between the latent image bearing body and the developing roll, and toner is reciprocated between the developing roll and the magnetic roll. The alternate current voltage source is common to the both biases and its wave is a square wave, a duty ratio of which is set in such a manner that a time for transferring toner from the magnetic roll to developing roll is shorter than a time for recovering toner from developing roll to the magnetic roll so as to prevent selective transfer of toner and carrier sticking to the developing roll utilizing the difference of inertia between toner and carrier.

The powder cloud developing method disclosed in the Japanese laid open patent publication, No. JP1992-113474 is not commonly practiced because weirs of auxiliary electrodes are apt to become dirty and image degradation generates owing to vibration. Further, the apparatuses disclosed in JP1999-231652, JP2000-81788 and JP1995-128983 have following drawbacks; namely, one needs a scratching device for toner and a recovery roll; another has a cause of degradation of toner durability owing to increasing toner stress by applying a special bias for recovery; yet another needs a long time for forming the layer on the developing roll at the time of developing reducing a developing speed. Further, after processing for a long time, charging property of toner varies greatly on the developing roll owing to degradation of durability of carrier leading to broadening the charging distribution of replenishing toner or recovered toner, which results in toner scattering or image fogging caused by poor toner charge. In addition, as the art needs a troublesome exchange of carrier, it does not have turned to a practical use.

In a tandem type developing apparatus disclosed in JP1988-249164, the action of developing apparatus except for an image forming part processing a transfer process needs to be stopped or the apparatus needs an apparatus or an control device for changing a high voltage applied between the developing roll and the magnetic roll with a high frequency resulting in cost up, while the apparatus has a structure of disposing donor roll, a magnetic roll and a stirrer member in a horizontal way so that downsizing of the apparatus is difficult. In a developing apparatus disclosed in JP1998-31366, a non-contact, two-component developer material method is carried out, while a plurality sets of developing magnetic poles on the magnetic roll and a trimming magnetic pole controlling a toner replenishing amount or a complex structure capable of fixing rotatably at a plurality of positions according to a replenishing amount of toner need to be provided inevitably leading to a complicated control method and a high cost developing apparatus.

An apparatus disclosed in JP1994-67546, JP1995-72733 or JP1995-92804 is operated by the powder cloud method in which the wires of the auxiliary electrodes are likely to get dirty and image degradation caused by vibration occurs. The apparatus disclosed in JP2000-250294 needs to bury electrodes into the developing roll and has a complicated and costly structure as necessary for a brush electrode for supplying the electrodes a superposed bias of AC and DC. The electrodes disposed intermittently in the circumferential direction while toner can not be controlled when the brush electrode becomes unable to contact the electrodes on the developing roll owing to sticking of toner caused by vibration or getting dirty for some reasons.

Further, as mentioned above, when high consistency images are printed successively, fine particles of toner and contamination of toner constituents stick to the developing roll that causes toner filming leading to unevenness of images such as generation of heterogeneous image consistency. These are problems when downsizing the developing apparatus.

SUMMARY OF THE INVENTION

The present invention was done for solving the above-mentioned problems. An object of the present invention is to provide a hybrid developing method wherein developing ghost and selective developing are avoided without complicating a developing apparatus and surly charged toner is supplied to a developing roll while unevenness of images is not generated to obtain stable images for a long time even when continuous printing.

Another object of the present invention is to provide an image forming method in a hybrid developing apparatus appropriate for a color tandem type image forming apparatus wherein stable quality images are obtained for a long time.

In order to attain these objects, according to the present invention, a method for developing in a hybrid developing apparatus having a magnetic roll for transferring two-component developer material, which electrostatically charges developer material consisting of carrier and toner magnetically held thereon, and a developing roll, which forms a toner alone thin layer on its surface by transferring the toner utilizing a bias for transferring and magnetic brushes of the magnetic roll wherein latent images on a latent image bearing body are developed with the toner by applying developing bias to nearest approached regions (developing regions) between the developing roll and the latent image bearing body, is characterized in that a data amount of each image, which an image forming apparatus prints and a number of paper sheets passed are detected and that an interval of the action of recovering and exchanging a toner layer on the developing roll to the magnetic roll after printing (between paper sheets) is variably set in accordance with a printing coefficient determined by the data amount and the number of paper sheets passed.

Thus, by variably setting an interval of the action of recovering and exchanging a toner layer on the developing roll to the magnetic roll after printing (between paper sheets) in accordance with a printing coefficient determined by the data amount and the number of paper sheets passed, toner filming caused by sticking fine particles or contamination of toner constituents is prevented even when images having consistency over 50% are successively printed. The unevenness of images such as generation of heterogeneous image consistency or unevenness of the toner layer caused by the toner filming can be avoided. When images with high consistency are successively printed, poor toner charge caused by selective developing of toner or deficiency of toner amount on the developing roll occurs so as to diminish toner performance regarding developing. According to the present invention, an appropriate amount of toner can constantly be supplied onto the developing roll so that generation of heterogeneous image consistency can be avoided while keeping enough printing rate. Therefore, excellent images can be obtained for a long time, preventing from generation of ghost, from staining of the developing roll or from poor performance for following solid images.

In this case, a rotational rate of the developing roll is 1.1 times or more that of the latent image bearing body so that enough toner is supplied to a latent image on the latent image bearing body without broadening the distance between paper sheets, printing rapidly; and a rotational rate of the developing roll is 1–2 times that of the magnetic roll so that toner exchanging on the developing roll is enhanced, avoiding stress to toner caused by insufficient recovery of toner, vibration or heat generation.

Further, changing rates of the volume average particle size of the toner on the developing roll is controlled within 15% by recovering and exchanging a toner layer on the developing roll to the magnetic roll so that generation of mottle in image consistency is prevented while a sufficient printing rate is maintained, and ghost, staining of the developing roll and faulty performance for following solid images are prevented, providing excellent images for a long time.

Even if a printing coefficient varies, uniform images are obtained by changing a toner amount on the developing roll within the range from 0.5 to 1.7 mg/cm$^2$. For example, in ordinary printing, toner scattering is diminished by setting a toner amount on the developing roll as comparatively small; in high consistency printing, an appropriate toner layer at the beginning of developing can be formed by supplying an enough amount of toner to the developing roll so that uniform images are always obtained.

Further, selective developing is avoided by controlling an amount of toner charge on the developing roll at the beginning of developing within the range from 5 to 20 $\mu$C/g, and toner scattering and diminishing of toner performance regarding developing are avoided by controlling a toner layer thickness to an optimum value, leading to obtaining excellent images for a long time.

Further, according to the present invention, the surface of the developing roll consists of an approximately uniform electro conductive sleeve having a conductivity of $10^6$ $\Omega\cdot cm^3$ or less to which a bias is applied. The applied bias is acted between the developing roll and the latent image bearing body and between the developing roll and the magnetic roll so that a toner layer on the developing roll is recovered and exchanged to the magnetic roll after printing (between paper sheets). Thus, the bias applied to the developing roll acts favorably to the gap between the rotating developing roll and the latent image bearing body and the magnetic roll so that image consistency does not decrease, leading to obtaining excellent images for a long time.

When a plurality of the aforementioned hybrid developing apparatuses for all different colors of toner are disposed along the moving direction of a transfer medium of images for applying to a color tandem type image forming apparatus, it is preferable that after toner layers on the developing rolls of the all developing apparatuses are peeled off to transfer toward the magnetic rolls after developing, a thickness of the toner layer of the each developing apparatus is variably controlled at the beginning of developing in accordance with the image consistency of the developing apparatus having a highest image consistency among image data of toner colors. Image consistency herein is a value corrected by a filter corresponding to each color with a Macbeth densitometry.

According to the present invention, a toner layer thickness in accordance with image consistency can always be obtained by calculating an image data amount of each toner color printed after toner layers on the developing rolls of the all developing apparatuses are peeled off to transfer toward the magnetic rolls after developing and by controlling variably a thickness of the toner layer of the each developing apparatus at the beginning of developing in accordance with the image consistency of the developing apparatus. Thus, image unevenness such as heterogeneous image consistency or non-uniform toner layer, which generates when high consistent images having a consistency of 50% or greater are successively printed, can be prevented. When images with high consistency are successively printed, poor toner charge caused by selective developing of toner or deficiency of toner amount on the developing roll occurs so as to diminish toner performance regarding developing. Even in this case, an appropriate amount of toner can constantly be supplied onto the developing roll so that generation of heterogeneous image consistency can be avoided while keeping enough printing rate. Therefore, an image forming method in a color tandem type image forming apparatus in which excellent images can be obtained for a long time, preventing from generation of ghost, from staining of the developing roll or from poor performance for following solid images can be provided.

According to an embodiment of a toner layer thickness controlled variably, a toner layer thickness at the beginning of developing is 1/10–1/4 of the gap between a developing roll and a latent image bearing body; a toner amount of the toner layer on the developing roll controlled variably at the beginning of developing is controlled to the range from 0.5 to 1.5 mg/cm$^2$; and an amount of toner charge on the developing roll at the beginning of developing is controlled to the range from 5 to 20 $\mu$/g. Thus, even if a data amount of images varies, even images are obtained. For example, toner scattering is diminished by setting a toner amount on the developing roll comparatively small in case of an ordinary printing and an appropriate toner layer is formed on the developing roll at the beginning of developing by supplying a sufficient amount of toner to the developing roll in case of a high consistent printing so as to always obtain even images. With the above method, a selective developing is prevented and toner scattering and decrease of developing performance are prevented by controlling a toner layer thickness to an optimum value so that a color tandem type image forming apparatus giving excellent images for a long time is provided.

Sufficient toner is supplied to a latent image on the latent image bearing body without enlarging a distance between paper sheets by rotating the developing roll 1.5 to 3 times as rapidly as the latent image bearing body so that a rapid printing can be performed.

Further according to the present invention, the developing bias consisting of a direct current bias and an alternate current bias superposed thereon is applied onto an electroconductive sleeve on the surface of the developing roll, the sleeve having a volume resistivity of $10^6$ $\Omega\cdot cm^3$ or smaller, so as to recover the toner layer on the developing roll to the magnetic roll after developing whereby the bias of a direct current bias and an alternate current bias superposed thereon acts favorably to the gap between the rotating developing roll and latent image bearing body, leading to obtaining a stable image for a long time without decreasing an image consistency.

BRIEF DESCRIPTION OF THE DRAWINGS

FIG. 7 is a table showing a state of generation of ghost and staining of the developing roll comparing with the case toner is exchanged and the case toner is not exchanged after printing continuously 10,000 sheets of printing data of 5% of image data.

FIG. 8 is a table showing a state of consistency and performance for following solid images comparing with the case toner is exchanged and the case toner is not exchanged after printing continuously 100 sheets of solid printing data of 100% of image data.

DETAILED DESCRIPTION OF THE PREFERRED EMBODIMENT

The invention will now be described below in detail by way of example with reference to the accompanying drawings. It should be understood, however, that the description herein of specific embodiments such as to the dimensions, the kinds of material, the configurations and the relative disposals of the elemental parts and the like is not intended to limit the invention to the particular forms disclosed but the intention is to disclose for the sake of example unless otherwise specifically described.

Figure 1:
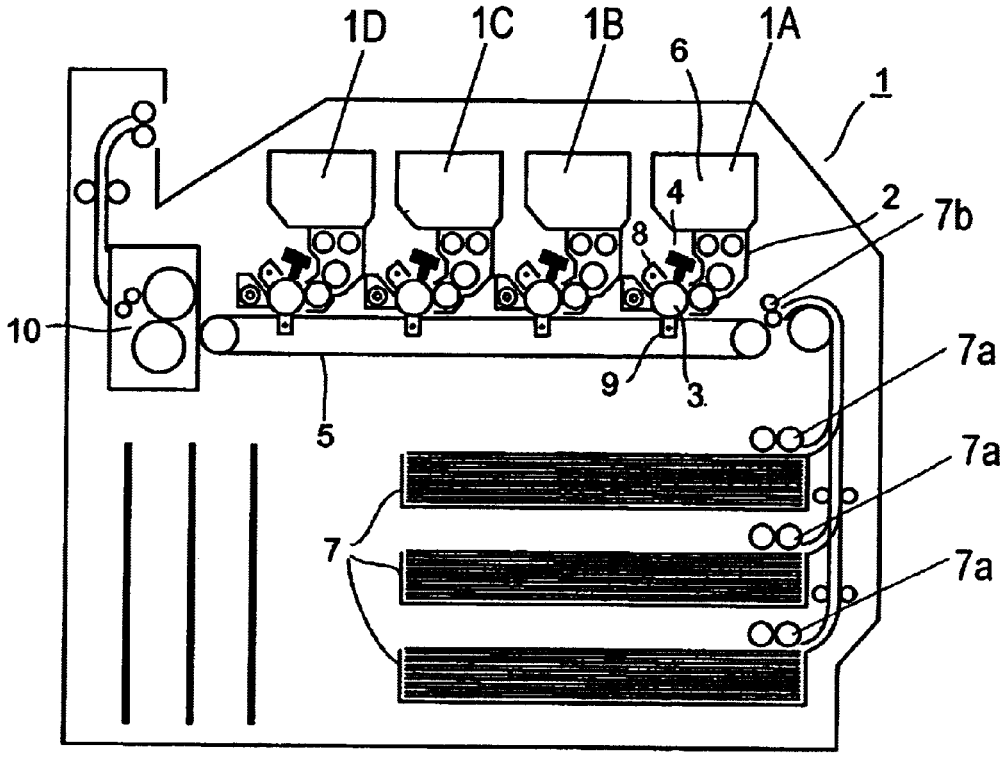
FIG. 1 is a schematic drawing illustrating an embodiment of a color tandem type image forming apparatus carrying out an image forming method according to the present invention.

In FIG. 1, 1 is a tandem type image forming apparatus having main units 1A–1D forming images of cyan, magenta, yellow and black and disposed along the transporting direction of a transporting belt for recording media. Each main unit 1A–1D includes a developing apparatus 2 having a developing container 6, a latent image bearing body (photosensitive body) 3, an exposing unit 4, a charging device 8 for charging the latent image bearing body 3 and a transferring device 9 for transferring toner images on the latent image bearing body 3 by means of a transferring bias, mounted therein.

7 is a cassette for supplying paper disposed under the main unit 1A–1D, having a structure layered vertically in three and leading a recording paper to a resist roller **7*b* through a paper-supplying roller 7*b*. By means of rotation of a resist roller 7*b*, a recording medium is transported on a route for transporting recording media, while color toner images are transferred by main units 1A–1D forming images of cyan, magenta, yellow and black. 10** is a fixing device fixing the color toner images.

In a color tandem type image forming device, it is important to design the devices disposed around the latent image bearing body (photosensitive body) 3 compact, the devices such as a charging device 8, an exposing unit 4, a developing apparatus 2, transferring device 9 and cleaning device. According to the present invention, a developing apparatus 2 is disposed adjacent to the latent image bearing body 3 and in a vertical direction.

Figure 2:
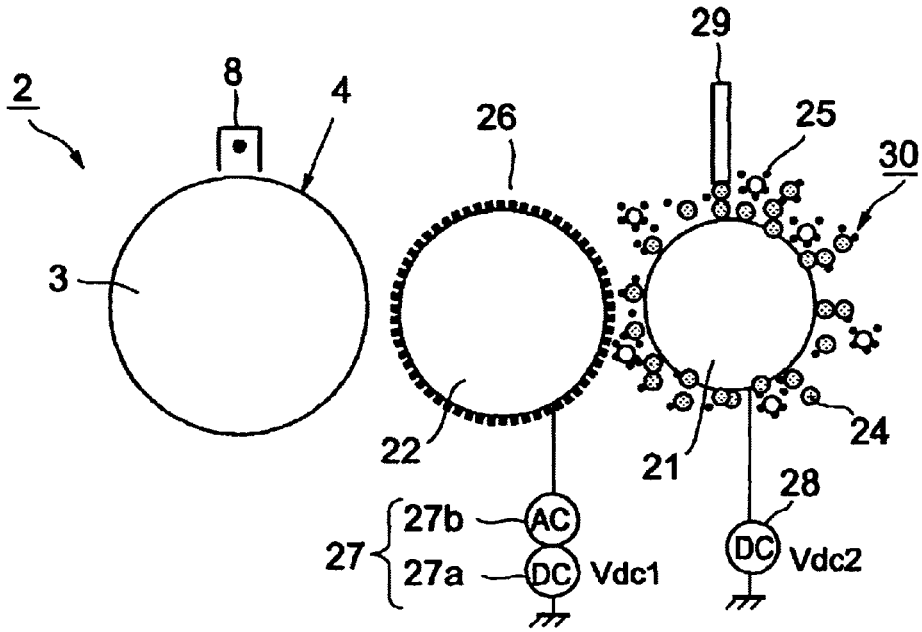
FIG. 2 is a schematic drawing illustrating a hybrid developing apparatus carrying out an image forming method according to the present invention.

In FIG. 2, 21 is a magnetic roll as a transporter for developer material generating magnetic brushes 30 of two-component developer material by a magnet disposed therein and supplying toner 25 to a developing roll 22; 22 is a developing roll holding a toner thin layer, which develops latent images on the latent image bearing body 3; 24 is carrier; 25 is toner; 26 is a toner thin layer on the developing roll 22; 27 is a developing bias for developing by causing toner 25 of the toner thin layer 26 formed on the developing roll to jump to the latent image bearing body, which is composed of a DC bias **27*a* ($V_{dc1}$) and an AC bias 27*b*; 28 is a DC bias ($V_{dc2}$) for transporting toner 25 from the magnetic roll to the developing roll 22; and 29 is a restricting blade for restricting the thickness of magnetic brushes 30 on the magnetic roll 21**.

As a material for latent image bearing body (photosensitive body) 3, an amorphous silicon (a-Si) photosensitive material, an organic photosensitive material (OPC) or the like may be used. Since an organic photosensitive material taking a positive charge (positive OPC) generate little ozone and the like, being stable in charge. Particularly, an organic photosensitive material taking a positive charge having a single layer structure is appropriate for a long life system because it does not varies in photosensitive characteristics even in case the film thickness is varied after long use so that image quality is stable. When an organic photosensitive material taking a positive charge is used in a long life system, its film thickness is preferably 20 $\mu$m to 40 $\mu$m. In case a film thickness of 20 $\mu$m or under is used, black spots are generated owing to dielectric breakdown when the thickness is decreased to approximately 10 $\mu$m. In case a film thickness of 40 $\mu$m or greater is used, a sensitivity is decreased causing decline of an image consistency.

As an exposing unit 4, a semiconductor laser or a LED can be used. When an organic photosensitive material taking a positive charge is used, a wavelength of 770 nm or vicinity is effective. When amorphous silicone photosensitive material is used, a wavelength of 685 nm or vicinity is effective. A case of using a LED as a light source of the exposing unit 4 and using an organic photosensitive material taking a positive charge as the latent image bearing body 3 is explained hereinafter according to the present invention.

A most surface of the developing roll comprises a sleeve consisting of uniformly conductive aluminum having a volume resistivity of $10^6$ Ω·cm$^3$ or under, SUS, or electroconductive film and the like. To the shaft part thereof is applied a DC bias ($V_{dc1}$) 27*a* and AC bias 27*b* so as to act the bias of the DC bias and the AC bias superposed thereon to the gap between the rotating developing roll 22 and the latent image bearing body 3 and to the gap between the rotating developing roll 22 and the magnetic roll 21. The AC component which the AC bias supplies comprises square waves having a duty ratio of 50% or less. According to the present invention, the DC bias ($V_{dc1}$) 27*a* is set as 100 V; the $V_{pp}$, the frequency and the duty ratio of the AC bias 27*b* are set as 1.5 kV, 3.0 kHz and 30% respectively as an example. As stated above, the DC bias ($V_{dc1}$) 27*a* and the AC bias 27*b* are applied directly to the developing roll 22 and the most surface of the developing roll consists of an electroconductive material having a volume resistivity of $10^6$ ∩·cm$^3$ so that sharp bias components can be applied between the developing roll 22 and the latent image bearing body 3, and between the developing roll and the magnetic roll 21 whereby enhancing reactivity of toner layer formation at the beginning of developing. A specific bias can be applied for adjusting formation of the toner layer at the time of formation of the toner layer till the beginning of developing depending on image data.

The magnetic roll 21 holds two-component developer material consisting of carrier 24 and toner 25 as a transporter for developer material, generating magnetic brushes 30 whose thickness is restricted by the restricting blade 29 and supplying the toner 25 to the developing roll 22. A gap between the restricting blade and the magnetic roll is preferably 0.3 to 1.5 mm. The toner 25 is supplied to the developing roll by a potential difference between the DC bias ($V_{dc2}$) 28 applied to the magnetic roll and DC bias ($V_{dc1}$) 27*a* applied to the developing roll and by the AC bias 27*b*. The voltage of the DC bias ($V_{dc2}$) 28 is 350 V as a example of the present invention and in order that the toner layer on the developing roll 22 may be exchanged after developing, the DC bias ($V_{dc2}$) 28 is converted as the AC bias 27*b* is applied so as to recover the toner thin layer 26 on the developing roll 22 to the magnetic brushes 30. A value changed of the DC bias (Vdc2) 28 is kept greater than a value which generates a potential in the direction for always transferring the toner of the magnetic brushes 30 to the developing roll 22, that is, a DC bias voltage to the magnetic roll is kept greater than that of the developing roll and if the DC bias ($V_{dc1}$) is 100 V, the value is greater than 100V (as for this example, the value between 100 V and 350 V). Regarding the variation of the DC bias, though the DC bias ($V_{dc2}$) 28 is converted in the above example, both a DC bias ($V_{dc2}$) 28 and a DC bias ($V_{dc1}$) 27*a* can be converted if a DC bias voltage of the magnetic roll 21 is kept greater than a DC bias voltage of the developing roll.

Figures 4, 5, 6:
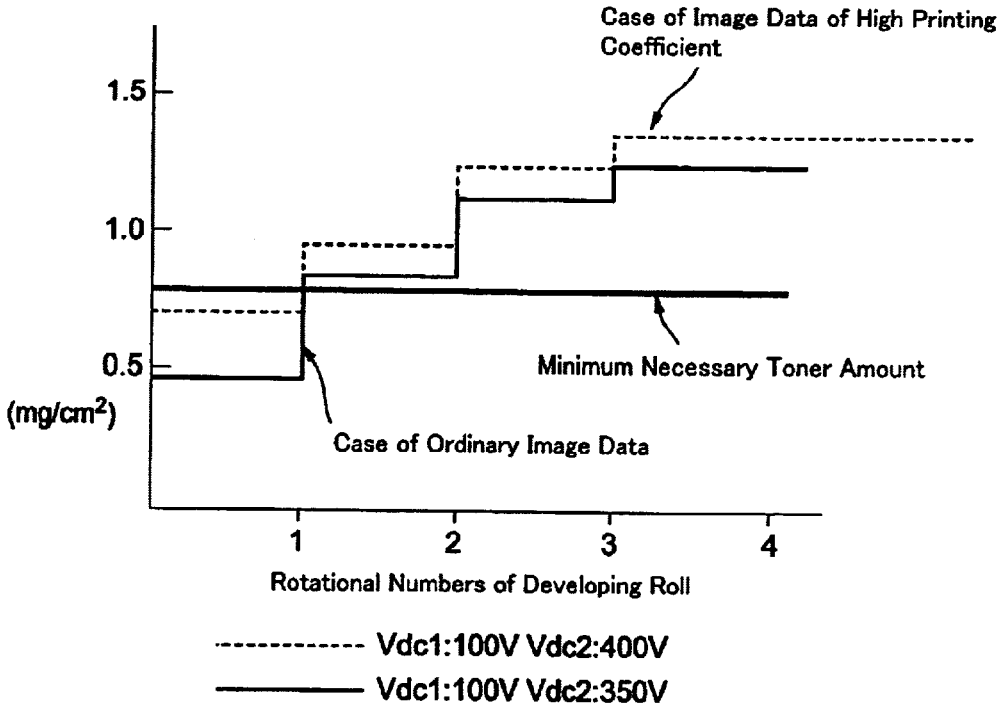
FIG. 4 is a table showing a relationship between a volume resistivity of a sleeve on a developing roll and an image consistency after printing 10,000 sheets (initial 1.43).
FIG. 5 is a graph showing a relationship between a rotational rate of a developing roll and a weight of a toner layer.
FIG. 6 is a schematic drawing illustrating a state of a thickness of a toner thin layer on the developing roll, ghost, scattering and performance for following solid images.

Conductivity of the sleeve on the developing roll 22 is related to maintaining property of printing consistency. The variation of image consistency (initial 1.43) after printing 10,000 sheets is shown in FIG. 4. A DC bias ($V_{dc1}$) 27*a* applied t the developing roll 22 is 100 V; A $V_{pp}$, a frequency and a duty ratio of the AC bias are 1.5 kV, 3.0 kHz and 30% respectively; and a DC bias ($V_{dc2}$) 28 is 350V. As a result: if a volume resistivity of the sleeve material is $10^7$ Ω·cm$^3$ or greater, image consistency after printing 10,000 sheets decreases extremely; and if it is $10^6$ Ω·cm$^3$ or less, there is almost no problem with regard to image consistency.

A gap between the latent image bearing body 3 and the developing roll 22 is approximately 250 μm as an example and no wire electrode is used between them. A gap between the latent image bearing body 3 and the developing roll 22 is usually 150 μm to 400 μm , preferably 200 μm to 300 μm. If the gap is less than 150 μm, it causes fogging. If it is grater than 400 μm, it becomes difficult to cause the toner 25 to jump to the latent image bearing body 3 so that enough image consistency cannot be obtained and causes selective developing. A gap between the magnetic roll 21 and the developing roll 22 is approximately 0.3 μm to 1.5 mm μm.

Developer material consists of toner 25 and carrier 24. It is important that the toner 25 is restricted with regard to its particle size distribution. Generally, a particle size distribution of toner is measured by a Coulter counter and a breadth of particle size distribution of a toner is expressed as a ratio of a volume average particle size and a number average particle size. In order to prevent selective developing, it is important to make the ratio small. The broader the distribution becomes, the more toner having a comparatively small particle size is deposit on the developing roll so that performance for developing decreases. According to the present invention, an amount of toner charge is controlled within the range of 5 μC/g to 20 μC/g to prevent selective developing. The amount of toner charge is related also to a layer thickness of the toner thin layer 26 formed on the developing roll 22 so that the thickness of the toner layer becomes thick when the amount of toner charge is as low as 10 μC/g or less, particularly 5 μC/g or less, leading to increasing scattering of toner. While, when the amount of toner charge is 20 μC/g or greater, the toner layer thickness becomes thin so that toner performance regarding developing decreases owing to high charge. The amount of toner charge is measured by sucking the toner thin layer 26 on the developing roll with a QM meter of Trek Co. In the present invention, a case of using positively charged toner is explained as an example. However, negatively charged toner may be also used by reversing the relation to the bias.

As for carrier 24, magnetite carrier, ferrite of Mn series, ferrite of Mn–Mg series can be used and surface treated material may also be used unless an appropriate resistivity does not increase. According to the present invention, silicone resin treated ferrite carrier having a volume resistivity of $10^8$ Ω·cm$^3$, a saturation magnetization of 70 emu/g and an average particle size of 35 μm is used as an example. When the average particle size exceeds 50 μm, the stress of carrier increases while the toner consistency can not be raised so that the toner supply to the developing roll diminishes. When the average particle size of carrier is less than 50 μm, enough charge is given so that stable developing can be carried out even when the toner concentration in the developer material ranges from 5 to 20%.

The mixing ratio of toner 25 and carrier 24 is from 5 to 20 weight % of toner per total amount of toner 25 and carrier 24, preferably from 5 to 15 weight %. When the mixing ratio of toner 25 is less than 5%, the amount of toner charge becomes high so that enough image consistency can not be obtained, while, when it exceeds 20%, toner can not get enough charge so that toner scatters from a developing device contaminating the inner part of an image forming apparatus or generating toner fogging on the images.

The thickness of a toner 25 thin layer 26 ranges from 10 to 100 μm, preferably from 30 to 70 μm. The thickness corresponds to 5 to 10 layers of the toner 25 and to 1/10 to 1/4 the gap between the developing roll and the latent image bearing body (150 to 400 μm, preferably 200 to 300 μm). Thus, according to the present invention, the thickness of the toner 25 layer formed on the electro-conductive sleeve on the developing roll is 50 μm or less and the toner amount is controlled within the range of from 0.5 to 1.7 mg/cm$^2$, preferably 0.5 to 1.5 mg/cm$^2$ whereby forming clear images on the latent image bearing body 3 and at the same time easing the exchange of toner on the developing roll 22, which result in controlling developing ghosts.

Further according to the present invention, in a series of image forming processes, clear images are formed on the latent image bearing body 3 and high consistent data can be continuously printed by controlling the thickness of the toner 25 layer formed on the sleeve of the developing roll 22 to 50 μm or less and the amount of the toner to within the range of from 0.5 to 1.7 mg/cm$^2$, preferably from 0.5 to 1.5 mg/cm$^2$.

Figures 3A, 3B:
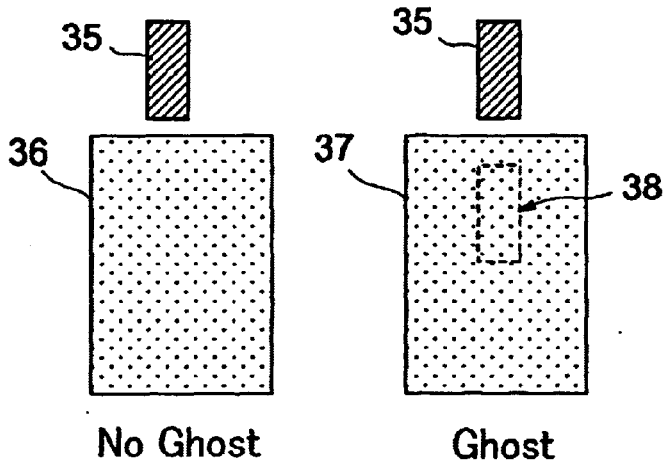
FIG. 3 is a schematic drawing illustrating generation of ghost.

The thickness of the toner thin layer 26 is determined by the difference between the DC bias ($V_{dc2}$) 28 and the DC bias ($V_{dc1}$) 27*a* and the amount of toner charge. In case the amount of toner charge is as low as 10 μC/g or less, particularly 5 μC/g or less, the toner layer becomes thin, rising the charge so that toner performance regarding developing diminishes. As described above, when the DC bias ($V_{dc1}$) 27*a* is set as 100 V and the DC bias ($V_{dc2}$) 28 as 350 V, the toner layer having a thickness of 40 μm is obtained. The toner amount per unit area in this condition is about 1.0 mg/cm$^2$. When the toner thin layer 26 is as thin as 0.5 mg/cm$^2$ or less, the following property of consistency is declined in case of successive printing of high consistent images, resulting in liability of generation of uneven images. When the toner layer is as thick as greater than 1.5 mg/cm$^2$, developing ghost as shown in FIG. 3 and toner scattering become noticeable. That is, as described above, in the FIG. 3, 35 is a rectangular, black and solid image. 36 and 37 are half tone images which succeed it and are broader than the former solid image 35. When a toner consumption region and a toner non-consumption region are generated on the developing roll and the half tone images 36, 37 are printed successively after printing the solid image 35, a ghost as 38 shown in FIG. 3(*b*) is generated.

In order to exchange the toner thin layer 26 on the developing roll, the toner thin layer 26 on the developing roll 22 is recovered to the magnetic brushes 30 by varying the DC bias ($V_{dc2}$) 28 in the state of applying the AC bias 27*b*. The exchange of toner on the developing roll 22 is enhanced by rotating the magnetic roll 21 one to two times as fast as the developing roll. It is preferable that the magnetic roll 21 rotates in the same direction as the developing roll 22; for example, when the developing roll 22 rotates counterclockwise, the magnetic roll rotates also counterclockwise. For supplying a latent image on the latent image bearing body 3 enough toner, toner is exchanged rapidly when the circumference rotating rate of the developing roll 22 is set 1.5 to 3 times as fast as that of the latent image bearing body 3. When the rate ratio is 1.5 times or less, time when developing begins is late so that an enough sheets distance is required, resulting in failure in rapid printing. When the rate ratio is 3 times or greater, vibration or heat is generated because of the increased rotation of the developing roll 22.

Toner performance for developing decreases sometimes when high consistent printings, for example, over 50% are successively performed with a compact type developing apparatus. One possible reason is selective developing of toner; another is deficiency of toner on the developing roll. As a measure for selective developing, it is proposed that toner is made return from developing roll 22 to the magnetic roll 21 by reverse electric field after developing. However the possibility of generating unevenness of image consistency becomes large because of deficiency of toner on the developing roll, which is the other possible reason.

Hence, to stabilize the image consistency, when printing data are transmitted, an image data amount of the printing data is calculated by a dot counter having an unshown control device of the image forming apparatus and the layer thickness of the toner thin layer 26 on the developing roll 22 is controlled in accordance with the image data amount. FIG. 5 is a graph showing a relationship between a number of rounds of the developing roll 22 and a weight of the toner thin layer 26 formed on the developing roll 22. In FIG. 5: a number of rounds of the developing roll 22 is plotted in horizontal axis and a weight of the toner layer 26 on the developing roll 22 in vertical axis; and the solid line denotes toner weights appropriate for image data of ordinary printing coefficient, and the dotted line denotes toner weights appropriate for image data of high printing coefficient. As for the DC bias ($V_{dc1}$) 27*a* applied to the developing roll 22 and the DC bias ($V_{dc2}$) applied to the magnetic roll 21, the DC bias ($V_{dc1}$) 27*a* is set as 100 V, and the DC bias ($V_{dc2}$) 28 is set as 350 V in case of solid line of image data of ordinary printing coefficient and 400 V in case of doted line of image data of high printing coefficient.

As shown in the graph, while a minimum toner weight needed on the developing roll 22 is about 0.7 to 0.8 g/cm$^2$, in case of the solid line corresponding to the ordinary printing coefficient where the DC bias ($V_{dc1}$) 27*a* is 100 V and the DC bias ($V_{dc2}$) 28 is 350 V, the toner weight becomes 0.4 to 0.5 mg/cm$^2$ after one round of the developing roll 22 and it surpasses the minimum necessary amount of 0.7 to 0.8 mg/cm$^2$after its two rounds. In case of the doted line corresponding to the high printing coefficient, the toner weight becomes 0.6 to 0.7 mg/cm$^2$ after one round of the developing roll 22 and 0.9 to 1.0 mg/cm$^2$ after its two round so that it surpasses also the minimum necessary amount of 0.7 to 0.8 mg/cm$^2$. Thus, the toner amount on the developing roll can be varied by controlling the voltage value of DC bias ($V_{dc2}$) 28.

That is, as stated above, the rotational rate of the magnetic roll 21 is set as one to two times as fast as that of the developing roll 22, the rotational direction of the magnetic roll is set as the same direction as that of the developing roll 22, and the voltage value of the DC bias ($V_{dc2}$) 28 of the developing roll 22 is controlled, so that the layer thickness of the toner thin layer 26 on the developing roll is controlled to 1/10 to 1/4 of the gap between the developing roll and the latent image bearing body 3 (150 to 400 μm, preferably 200 to 300 μm) in accordance with the data amount of printing data. Thus, for successive printings, the printing coefficient of printing data is calculated by a dot counter provided with a control device of the image forming apparatus. The DC bias (Vdc2) 28 is varied by the printing coefficient so as to obtain an even image. The above-mentioned process is important for preventing toner scattering from the developing roll 22. Toner scattering is decreased by setting toner amount on the developing roll as comparatively little at the time of ordinary printing. The toner amount on the developing roll is adjusted only when it is necessary, such as at the time of high consistent printing so that an optimum toner layer can be formed at the beginning of developing.

In FIG. 6, ghost, scattering and performance for following solid images are shown by varying the thickness (mg/cm$^2$)

of the toner thin layer on the developing roll 22. ○ denotes good performance, Δ denotes the case where the defects are observed a little and × denotes bad performance. As shown in FIG. 6: when the toner layer is too thin as 0.4 mg/cm$^2$, performance for following solid images is declined; when the toner layer is too thick as over 1.7 mg/cm$^2$, developing ghost and toner scattering are inclined to be apparent. Thus, the thickness (mg/cm$^2$) of the toner thin layer 26 is preferably approximately 0.5 to 1.5 (mg/cm$^2$).

In a tandem type image forming apparatus having a hybrid developing apparatus thus constructed according to the present invention, two components developer material consisting of toner 25 corresponding to an individual color such as yellow, cyan, magenta or black and carrier 24 is supplied to the developing apparatus 2 from the developing container 6, forming the magnetic brushes 30 on the magnetic roll 21 as shown in FIG. 2 and charging the toner 25 by stir. The magnetic brushes 30 on the magnetic roll 21 is restricted with its layer thickness by the restricting blade 29 and the thin layer of the only toner 25 is formed on the developing roll 22 by the potential difference between the DC bias ($V_{dc2}$) 28 applied to the magnetic roll 21 and the DC bias ($V_{dc1}$) 27*a*, and AC bias 27*b*.

When the signal for beginning printing is transmitted from an unshown control circuit, the latent image bearing body 3 comprising organic photosensitive material taking a positive charge (positive OPC) is charged at first by the charging device 8, for example to 400 V and after that, the latent image bearing body 3 is exposed by LED which an exposing unit comprises and having a wave length of 770 nm to a potential of 70 V after exposing to form a latent image. The latent image is developed to form a toner image with toner caused to jump to the latent image bearing body 3 from the toner thin layer 26 on the developing roll 22 by the DC bias ($V_{dc1}$) 27*a* and AC bias 27*b*.

By the time a toner image is formed on the latent image bearing body 3, a recording medium is taken from a cassette for supplying paper and transported onto a transporting belt 5. A toner image is transferred by applying a transfer bias by a transfer device 9 disposed at the transfer position of individual color. The toner image of each color is sequentially transferred to the recording medium, which reaches a fixing device 10, is fixed, and discharged.

The AC bias 27*b* applied to the developing roll is a square wave having a duty ratio of 50% or less. The period for transporting toner 25 from the magnetic roll 21 to the developing roll is shorter than the period for recovering toner 25 from the developing roll 22 to the magnetic roll 21. Because the DC bias ($V_{dc1}$) 27*a* and the AC bias 27*b* is applied directly to the developing roll and the most surface of the developing roll 22 is made of electro-conductive material having a volume resistivity of $10^6$ Ω·cm$^3$ or less, AC component of the bias for recovering the toner thin layer 26 on the developing roll to the magnetic roll 21 has a sharp peak so as to recover the toner 25 effectively. Therefore, the effectiveness of recovering toner from developing roll 22 to the magnetic roll 21, which is a transporter for developer material, is enhanced so that staining of the developer roll with toner is prevented and recovery of toner from the latent image bearing body 3 toward the developing roll is effectively performed, which result in providing a developing apparatus capable of obtaining quality images having long stability and preventing generation of fogging.

Further, according to the present invention, when printing data are transmitted, a printing coefficient of the image data of the individual toner color used in the color tandem type image forming apparatus is calculated by a dot counter having an unshown control device of the image forming apparatus and the toner thin layer 26 is peeled off from the developing roll 22 for refreshing while the layer thickness of the toner is variably controlled at the beginning of developing in accordance with the image consistency of a developing apparatus where the image consistency is highest. The refreshing is carried out in such a manner that the toner thin layer 26 on the developing roll 22 is recovered to the magnetic brushes 30 by varying the DC bias ($V_{dc2}$) 28 in the state of applying the AC bias 27*b* and the thickness of the toner is varied by getting back to a voltage in accordance with the image consistency at the beginning of developing. Thus, the layer thickness of the toner thin layer 26 on the developing roll is controlled to 1/10 to 1/4 of the gap between the developing roll and the latent image bearing body 3 (150 to 400 μm, preferably 200 to 300 μm) so as to prevent generation of ghost, staining of developing roll and poor performance for following solid images, whereby a method for developing in a compact color tandem type image forming apparatus capable of giving quality images for a long time can be provided.

A voltage value of the DC bias ($V_{dc1}$) 27*a*, the AC bias 27*b* or the DC bias 28, $V_{pp}$ or the frequency that has been explained above is an example and is obviously variable according to the situation.

Hence, according to the present embodiment, after action of peeling the toner layer from the developing roll toward the magnetic roll is carried out at the end of developing, an amount of the image data of individual toner color which is printed is calculated and the layer thickness of the toner is variably controlled at the beginning of developing in accordance with the image consistency of a developing apparatus where the image consistency is highest so that a toner layer corresponding to an image consistency is always obtained. Therefore, unevenness of image such as mottle in image consistency or unevenness of the toner layer which occurs when high consistent images, for example, having an image consistency of 50% or greater, are successively printed can be avoided. When images with high consistency are successively printed, poor toner charge caused by selective developing of toner or deficiency of toner amount on the developing roll occurs so as to diminish toner performance regarding developing. Even in this case, an appropriate amount of toner can constantly be supplied onto the developing roll so that generation of ghost, staining of the developing roll or poor performance for following solid images is prevented, whereby excellent images are obtained for a long time.

Further, according to the present invention, a toner layer thickness at the beginning of developing is 1/10–1/4 of the gap between a developing roll and a latent image bearing body; a toner amount of the toner layer is controlled to the range from 0.5 to 1.5 mg/cm$^2$; and an amount of toner charge is controlled to the range from 5 to 20 μ/g. Thus, even if a data amount of images varies, even images are obtained. For example, toner scattering is diminished by setting a toner amount on the developing roll relatively small in case of an ordinary printing and an appropriate toner layer is formed on the developing roll at the beginning of developing by supplying a sufficient amount of toner to the developing roll in case of a high consistent printing so as to always obtain even images. With the above method, a selective developing is prevented and toner scattering and decrease of developing performance are prevented by controlling a toner layer thickness to an optimum value so that a color tandem type image forming apparatus giving excellent images for a long time is provided.

Further, according to the present embodiment, sufficient toner is supplied to a latent image on the latent image bearing body without enlarging a distance between paper sheets by rotating the developing roll 1.5 to 3 times as rapidly as the latent image bearing body so that a rapid printing can be performed.

Further, according to the present embodiment, the developing bias consisting of a direct current bias and an alternate current bias superposed thereon is applied onto an electroconductive sleeve on the most surface of the developing roll, the sleeve having a volume resistivity of $10^6$ $\Omega \cdot cm^3$ or smaller, so as to recover the toner layer on the developing roll to the magnetic roll after developing whereby the bias of a direct current bias and an alternate current bias superposed thereon acts favorably to the gap between the rotating developing roll and latent image bearing body, leading to obtaining a stable image for a long time without decreasing an image consistency.

FIG. 7 and FIG. 8 illustrate the second embodiment of the present invention. FIG. 7 is a table showing a state of generation of ghost and staining of the developing roll comparing with the case toner is exchanged and the case toner is not exchanged after printing continuously 10,000 sheets of printing data of 5% of image data. FIG. 8 is a table showing a state of consistency and performance for following solid images comparing with the case toner is exchanged and the case toner is not exchanged after printing continuously 100 sheets of solid printing data of 100% of image data.

As stated above, when high consistent printings, for example, over 50% are successively performed, fine particles of toner and stain of toner component adhere to the developing roll, that is, so called toner filming occurs, which is apt to causes unevenness of image such as mottle in image consistency owing to the uneven toner thin layer 26 on the developing roll 22. Toner performance for developing on the developing roll 22 decreases sometimes when high consistent printings are successively performed with a compact type developing apparatus. One possible reason is selective developing of toner; another is deficiency of toner on the developing roll. As a measure for selective developing, it is proposed that toner is made return from developing roll 22 to the magnetic roll 21 by reverse electric field after developing. However the possibility of generating unevenness of image consistency becomes large because of deficiency of toner on the developing roll at the beginning of next developing, which is the other possible reason.

Hence, in order to stabilize the image consistency of successive printing: when printing data are transmitted, an image data amount of each image is detected by a dot counter having an unshown control device of the image forming apparatus; the toner thin layer 26 is peeled off regularly after printing (between paper sheets) from the developing roll 22 in accordance with a printing coefficient determined by the data amount and the number of paper sheets passed; and an interval of the action of recovering and exchanging a toner layer on the developing roll 22 to the magnetic roll 21 is variably set for refreshing. Though toner is usually refreshed if toner is peeled off at every time after developing, time for forming again a stable toner layer is necessary so that an enough printing rate cannot be attained.

FIG. 7 and FIG. 8 show an effect of the case of peeling off the toner thin layer 26 from the developing roll regularly in accordance with a printing coefficient. FIG. 7 shows a state of ghost and stain of the developing roll, variation of a toner charge amount, and variation of a volume average particle size. A sample of toner for toner particle size measurement is taken from the toner on the developing roll. As for ghost and a level of staining the developing roll: ○ denotes the case that ghost part 38 shown in FIG. 3 or staining of the developing roll is not observed; Δ denotes the case that the phenomenon is observed a little; and × denotes the case that the phenomenon is apparently observed.

As shown in FIG. 7, if a toner layer is not exchanged in case of the successive printing even when the image data of the printing data is 5%, the toner charge increases so that a volume average particle size as well as a consistency of the toner reduces, which result in that the ghost and the staining of the roll are apparently observed. On the contrary, if the toner layer is changed after every 20 sheets printing, though the toner charge is increased a little, a volume average particle size as well as a consistency of the toner reduces little; consequently, the ghost and the staining of the roll are not observed.

FIG. 8 shows a state of consistency and performance for following solid images, variation of a toner charge amount, and variation of a volume average particle size under the following case: a case where the toner layer is not exchanged after the successive printing of 100 sheets of the solid printing data having an image data of 100%; a case where the toner layer is exchanged after every 10 sheets printing; a case where the toner layer is exchanged after every 10 sheets printing and when high consistent printing data having an image consistency of 30% or more are successively transmitted, a potential difference between the DC bias (Vdc2) 28 of the magnetic roll 21 for example 350 V and the DC (Vdc1) 27*a* of the developing roll increases by 50 V. In this example, the DC bias (Vdc2) is 350 V, however, the bias may be lower than the potential of the photosensitive body.

As shown in FIG. 8, when the printing data is 100%, the performance for following solid images becomes faulty unless the toner layer is not exchanged, the consistency is greatly decreased and the loner charge amount as well as the toner volume average particle size are also decreased. On the contrary, when the toner layer is exchanged after every 10 sheets printing, though the toner charge amount is decreased a little, the performance for following solid images is good and the toner volume average particle size is not decreased so greatly. And when the toner layer is exchanged after every 10 sheets printing while a potential difference between the DC bias (Vdc2) 28 of the magnetic roll 21 and the DC (Vdc1) 27*a* of the developing roll is increased by 50 V, all the factors of the consistency, the performance for following solid images, the toner charge amount, and the volume average particle size are excellent.

Consequently, when the toner layer on the developing roll 22 is not exchanged, ghost, staining of the developing roll and faulty performance for following solid images are generated in any cases of 5% and 100% solid images. The state is improved only by exchanging the toner layer after every 20 sheets printing in case of an image data of 5% and every 20 sheets printing in case of solid (100%) images. Further, when a potential difference between the DC bias (Vdc2) 28 of the magnetic roll 21 and the DC (Vdc1) 27*a* of the developing roll is increased by 50 V, more excellent results are obtained. A volume average particle size of the toner of 6.41 in case of after 100 sheets successive printing without exchange of toner varies by a percentage change of 16% from the initial value of 7.55. Seeing this value, it is thought that a volume average particle size of the toner may to be controlled by exchanging the toner layer.

Namely, when successive printing data are transmitted, a data amount of individual image data is detected by a dot counter and when a printing data amount of 5 pages or more of a data of 30% or greater continues, a distance between sheets is controlled so as to broaden by a distance, for example about 10 to 20 mm, in accordance with a printing coefficient determined by the data amount and the number of paper sheets passed, recovering the toner thin layer 26 on the developing roll to the magnetic roll 21 and replenishing the toner to the developing roll 22 after that.

Thus, the changing rates of the volume average particle size of the toner thin layer 26 on the developing roll 22 is controlled within 15% so that ghost, staining of the developing roll and faulty performance for following solid images are prevented, providing excellent images for a long time.

In order to exchange the toner thin layer 26 on the developing roll 22, the toner thin layer 26 on the developing roll 22 is recovered to the magnetic brushes 30 by varying the DC bias ($V_{dc2}$) 28 in the state of applying the AC bias 27*b* after developing. On the occasion of the toner exchange, the time period for recovering and replenishing the toner layer on the developing roll is adjusted by adjusting the distance between the paper sheets in order to maintain an excellent printing rate. When the rotational rate of the magnetic roll 21 is determined as one to two times that of the developing roll 22, the exchange of the toner on the developing roll is enhanced. It is preferable that the magnetic roll 21 rotates in the same direction as the developing roll 22; for example, when the developing roll 22 rotates counterclockwise, the magnetic roll rotates also counterclockwise. If the ratio of rotational rates of the developing roll and the magnetic roll is unity, toner recovery from the developing roll is not enough. If the ratio is 2 times or greater, the rotational rate of the magnetic roll is increased, causing vibration or heat generation and increasing stress to toner.

In order to supply sufficient toner onto the latent image on the latent image bearing body without broadening the sheets distance, rapid toner exchange is possible when the circumferential rotational rate of the developing roll 22 is set as 1.1 times that of the latent image bearing body. When the ratio is 1.1 or less, a large sheets distance is required because time for beginning developing is too long so that rapid printing cannot be attained.

A saturated toner amount of the toner thin layer 26 on the developing roll 22 is determined by the difference between the DC bias ($V_{dc2}$) 28 and the DC bias ($V_{dc1}$) 27*a*. Hence, when the DC bias ($V_{dc2}$) 28 is set as 350 V and the DC bias ($V_{dc1}$) 27*a* as 100 V, the toner layer having a thickness of approximately 1.0 mg/cm$^2$ is obtained after a rotation of two rounds of the developing roll. Though adjustment of the toner layer can be done basically by the difference between the DC bias ($V_{dc2}$) 28 and the DC bias ($V_{dc1}$) 27*a*, factors such as an amount of toner charge and a magnetic strength of the developing roll. Therefore, when successive printing is carried out, a printing coefficient of the printing data is detected by a dot counter provided in the control device of the image forming apparatus and the DC bias ($V_{dc2}$) 28 is varied in accordance with the printing coefficient so as to obtain an even image. This process is important as toner scattering from the developing roll is prevented. An amount of toner on the developing roll is set as comparatively small at ordinary printing so as to avoid scattering and an amount of toner on the developing roll is adjusted only when needed such as high consistent printing so as to form an optimum toner layer at the beginning of developing. As explained in FIG. 8, it is advantageous to set the difference between the DC bias ($V_{dc1}$) 28 and the DC bias ($V_{dc1}$) 27*a* as a little high.

In an tandem type image forming apparatus according to the present invention having a hybrid developing apparatus constituted as mentioned above, two-components developed material consisting of toner 25 corresponding to an individual color such as yellow, cyan, magenta or black and carrier 24 is supplied to the developing apparatus 2 from the developing container 6, forming the magnetic brushes 30 and charging the toner 25 by stir. The magnetic brushes 30 on the magnetic roll 21 is restricted with its layer thickness by the restricting blade 29 and the thin layer of the only toner 25 is formed on the developing roll 22 by the potential difference between the DC bias ($V_{dc2}$) 28 applied to the magnetic roll 21 and the DC bias ($V_{dc1}$) 27*a*, and AC bias 27*b*.

When the signal for beginning printing is transmitted from an unshown control circuit, the latent image bearing body 3 comprising organic photosensitive material taking a positive charge (positive OPC) is charged at first by the charging device 8, for example to 400 V and after that, the latent image bearing body 3 is exposed by LED which an exposing unit comprises and having a wave length of 770 nm to a potential of 70 V after exposing to form a latent image. The latent image is developed to form a toner image with toner caused to jump to the latent image bearing body 3 from the toner thin layer 26 on the developing roll 22 by the DC bias ($V_{dc1}$) 27*a* and AC bias 27*b*.

By the time a toner image is formed on the latent image bearing body 3, a recording medium is taken from a cassette for supplying paper and transported onto a transporting belt 5. A toner image is transferred by applying a transfer bias by a transfer device 9 disposed at the transfer position of individual color. The toner image of each color is sequentially transferred to the recording medium, which reaches a fixing device 10, is fixed, and discharged.

The AC bias 27*b* applied to the developing roll 22 is a square wave having a duty ratio of 50% or less. The period for transporting toner 25 from the magnetic roll 21 to the developing roll is shorter than the period for recovering toner 25 from the developing roll 22 to the magnetic roll 21. Because the DC bias (Vdc1) 27*a* and the AC bias 27*b* is applied directly to the developing roll and the most surface of the developing roll 22 is made of electro-conductive material having a volume resistivity of $10^6$ Ω·cm$^3$ or less, AC component of the bias for recovering the toner thin layer 26 on the developing roll to the magnetic roll 21 has a sharp peak so as to recover the toner 25 effectively. Therefore, the effectiveness of recovering toner from developing roll 22 to the magnetic roll 21, which is a transporter for developer material, is enhanced so that staining of the developer roll with toner is prevented and recovery of toner from the latent image bearing body 3 toward the developing roll is effectively performed, which result in providing a developing apparatus capable of obtaining quality images having long stability and preventing generation of fogging.

Further, according to the present invention, when an unshown control circuit receives printing data, an image data amount of each image is detected by a dot counter having an unshown control device of the image forming apparatus; the toner thin layer 26 is regularly peeled off at an interval in accordance with a printing coefficient determined by the data amount and the number of paper sheets passed so as to refresh toner by recovering and exchanging the toner layer on the developing roll 22 to the magnetic roll 21. The refreshing is carried out in such a manner that the toner thin layer 26 on the developing roll 22 is recovered to the magnetic brushes 30 at a period between the sheets distance after developing by varying the DC bias ($V_{dc2}$) 28 in the state of applying the AC bias 27*b*. On the occasion of the toner exchange, the time period for recovering and replenishing the toner layer on the developing roll is adjusted by adjusting the distance between the paper sheets in order to maintain an excellent printing rate. When thus the percentage change of a volume resistivity of the toner thin layer 26 on the developing roll 22 is controlled within 15% and the amount of toner charge is controlled within the range of between 5 and 20 $\mu$C/g, a rapid, inexpensive and compact tandem-type image forming apparatus can be provided having a compact hybrid-type developing apparatus which gives an excellent images whose image quality is stable for a long time, preventing from generation of ghost, staining the developing roll and faulty performance for following solid images.

A voltage value of the DC bias ($V_{dc1}$) 27*a*, the AC bias 27*b* or the DC bias 28, $V_{pp}$ or the frequency that has been explained above is an example and is obviously variable according to the situation.

Therefore, according to the second embodiment of the present invention, by variably setting an interval of the action of recovering a toner layer on the developing roll to the magnetic roll after printing (between paper sheets) in accordance with a printing coefficient determined by the data amount and the number of paper sheets passed, toner filming caused by sticking fine particles or contamination of toner constituents is prevented even when images having consistency over 50% are successively printed. The unevenness of images such as generation of heterogeneous image consistency or unevenness of the toner layer caused by the toner filming can be avoided. When images with high consistency are successively printed, poor toner charge caused by selective developing of toner or deficiency of toner amount on the developing roll occurs so as to diminish toner performance regarding developing. Even on this occasion, an appropriate amount of toner can constantly be supplied onto the developing roll so that generation of heterogeneous image consistency can be avoided while keeping enough printing rate. Therefore, excellent images can be obtained for a long time, preventing from generation of ghost, from staining of the developing roll or from poor performance for following solid images.

In this case, a rotational rate of the developing roll is 1.1 times or more that of the latent image bearing body so that enough toner is supplied to a latent image on the latent image bearing body without broadening the distance between paper sheets, printing rapidly; and a rotational rate of the developing roll is 1–2 times that of the magnetic roll so that toner exchanging on the developing roll is enhanced, avoiding stress to toner caused by insufficient recovery of toner, vibration or heat generation.

Further, the changing rates of the volume average particle size of the toner thin layer 26 on the developing roll 22 is controlled at first within 15% by recovering and exchanging the toner layer on the developing roll to the magnetic roll so that unevenness of image consistency, ghost, staining of the developing roll and faulty performance for following solid images are prevented while a sufficient printing rate is maintained, providing a developing method in an image forming apparatus which gives excellent images for a long time.

Even if a printing coefficient varies, uniform images are obtained by changing a toner amount on the developing roll within the range from 0.5 to 1.7 mg/cm$^2$. For example, in ordinary printing, toner scattering is diminished by setting a toner amount on the developing roll as comparatively small; in high consistency printing, an appropriate toner layer at the beginning of developing can be formed by supplying an enough amount of toner to the developing roll so that uniform images are always obtained.

Further, selective developing is avoided by controlling an amount of toner charge on the developing roll at the beginning of developing with the range from 5 to 20 $\mu$C/g, and toner scattering and diminishing of toner performance regarding developing are avoided by controlling a toner layer thickness to an optimum value, leading to obtaining excellent images for a long time.

Further, the surface of the developing roll consists of an approximately uniform electro conductive sleeve having a conductivity of $10^6$ $\Omega\cdot$cm$^3$ or under to which a bias is applied. Thus, the bias applied to the developing roll acts favorably to the gap between the rotating developing roll and the latent image bearing body and the magnetic roll so that image consistency does not decrease, leading to obtaining excellent images for a long time.

What is claimed is:

1. A method for developing in a hybrid developing apparatus having a magnetic roll for transferring two-component developer material, which electrostatically charges developer material consisting of carrier and toner magnetically held thereon, and a developing roll, which forms a toner thin layer on its surface by transferring the toner utilizing a bias for transferring and magnetic brushes of the magnetic roll wherein latent images on a latent image bearing body are developed with the toner by applying developing bias to nearest approached regions developing regions, between the developing roll and the latent image bearing body, characterized in that amount of data of each image, which an image forming apparatus prints and a number of paper sheets passed are detected and that an interval of the action of recovering and exchanging a toner layer on the developing roll to the magnetic roll after printing between paper sheets is variably set in accordance with a printing coefficient determined by the data amount and the number of paper sheets passed.

2. A method for developing in a hybrid developing apparatus according to claim 1, wherein a rotational rate of the developing roll is 1.1 times or more that of the latent image bearing body and a rotational rate of the developing roll is from one to two times that of the magnetic roll.

3. A method for developing in a hybrid developing apparatus according to claim 1, wherein changing rates of a volume average particle size of the toner on the developing roll is controlled within 15% by recovering and exchanging a toner layer on the developing roll to the magnetic roll.

4. A method for developing in a hybrid developing apparatus according to claim 1, wherein when the toner layer on the developing roll is recovered and exchanged to the magnetic roll, a toner amount on the developing roll is changed within the range from 0.5 to 1.7 mg/cm$^2$ in accordance with amount of data of each image.

5. A method for developing in a hybrid developing apparatus according to claim 1, wherein an amount of toner charge on the developing roll at the beginning of developing is controlled within the range of from 5 to 20 $\mu$C/g by recovering and exchanging the toner layer on the developing roll to the magnetic roll.

6. A method for developing in a hybrid developing apparatus according to claim 1, wherein the surface of the developing roll consists of an approximately uniform electroconductive sleeve having a conductivity of $10^6$ $\Omega$cm$^3$ or less to which a bias is applied, and the applied bias is acted between the developing roll and the latent image bearing body and between the developing roll and the magnetic roll so that a toner layer on the developing roll is recovered and exchanged to the magnetic roll after printing between paper sheets.

7. A method for developing in a color tandem-type image forming apparatus provided with a plurality of hybrid developing apparatuses defined in claim 1 for all different colors of toner, which are disposed along the moving direction of a transfer medium of images, wherein after toner layers on the developing rolls of the all developing apparatuses are peeled off toward the magnetic rolls after developing, a thickness of the toner layer of the each developing apparatus is variably controlled at the beginning of developing in accordance with the image consistency of the developing apparatus having a highest image consistency among image data of toner colors.

8. A method for developing in a color tandem-type image forming apparatus according to claim 7, wherein a toner layer thickness at the beginning of developing is 1/10–1/4 of the gap between a developing roll and a latent image bearing body.

9. A method for developing in a color tandem-type image forming apparatus according to claim 7, wherein a toner amount of the toner layer on the developing roll controlled variably at the beginning of developing is controlled to the range within from 0.5 to 1.5 $mg/cm^2$.

10. A method for developing in a color tandem-type image forming apparatus according to claim 7, wherein an amount of toner charge on the developing roll at the beginning of developing is controlled to the range from 5 to 20 $\mu C/g$.

11. A method for developing in a color tandem-type image forming apparatus according to claim 7, wherein the developing roll rotates 1.5 to 3 times as rapidly as the latent image bearing body.

12. A method for developing in a color tandem-type image forming apparatus according to claim 7, wherein a developing bias consisting of a direct current bias and an alternate current bias superposed thereon is applied onto an electroconductive sleeve on the surface of the developing roll, the sleeve having a volume resistivity of $10^6$ $\Omega \cdot cm^3$ or smaller, so as to recover the toner layer on the developing roll to the magnetic roll after developing.

* * * * *